US007608159B2

(12) United States Patent
Fellinger et al.

(10) Patent No.: US 7,608,159 B2
(45) Date of Patent: Oct. 27, 2009

(54) METHOD OF MAKING A NODULAR INORGANIC FIBROUS INSULATION

(75) Inventors: Thomas John Fellinger, Littleton, CO (US); Stephen Young, Liberty, IN (US); John Brooks Smith, Centennial, CO (US)

(73) Assignee: Johns Manville, Denver, CO (US)

( * ) Notice: Subject to any disclaimer, the term of this patent is extended or adjusted under 35 U.S.C. 154(b) by 581 days.

(21) Appl. No.: 11/471,255

(22) Filed: Jun. 20, 2006

(65) Prior Publication Data

US 2006/0283135 A1 Dec. 21, 2006

Related U.S. Application Data

(63) Continuation of application No. PCT/US2004/043318, filed on Dec. 22, 2004.

(60) Provisional application No. 60/532,743, filed on Dec. 23, 2003, provisional application No. 60/532,880, filed on Dec. 23, 2003, provisional application No. 60/532,881, filed on Dec. 23, 2003, provisional application No. 60/532,882, filed on Dec. 23, 2003.

(51) Int. Cl.
*E04B 2/00* (2006.01)

(52) U.S. Cl. ..... 156/71; 264/112

(58) Field of Classification Search ..... None
See application file for complete search history.

(56) References Cited

U.S. PATENT DOCUMENTS 2,664,376 A 12/1953 Philipps
3,995,775 A 12/1976 Birkmeier et al.
4,134,242 A 1/1979 Musz et al.
4,199,281 A 4/1980 Wolf
4,203,155 A 5/1980 Garst
4,272,935 A 6/1981 Lukas et al.
4,487,365 A 12/1984 Sperber
4,648,920 A 3/1987 Sperber
4,673,594 A 6/1987 Smith
4,710,480 A 12/1987 Buschmann et al.
4,773,960 A 9/1988 Vincelli et al.
4,804,695 A 2/1989 Horton
4,923,121 A 5/1990 Boyer
5,035,936 A * 7/1991 Dockrill et al. ..... 156/71
5,114,281 A 5/1992 Hartnett et al.
5,131,590 A 7/1992 Sperber
5,209,608 A 5/1993 Edwards
5,641,368 A 6/1997 Romes et al.
5,666,780 A 9/1997 Romes et al.
5,669,740 A 9/1997 Twonsend et al.
5,921,055 A 7/1999 Romes et al.
5,952,418 A 9/1999 Romes et al.
6,012,263 A 1/2000 Church et al.
6,262,164 B1 7/2001 Church et al.

* cited by examiner

*Primary Examiner*—Mary Lynn F Theisen
(74) *Attorney, Agent, or Firm*—Robert D. Touslee

(57) ABSTRACT

A method of forming a nodular insulation material suitable for installation in a cavity, comprising: propelling fibrous nodules at a substrate, wherein the fibrous nodules are formed from inorganic fibers, wherein the majority of the nodules have a maximum dimension of about one-half inch, and contacting the nodules while the nodules are being propelled, with a solution comprising water and a water soluble binder to produce coated nodules, wherein the coated nodules form an insulation on the substrate.

28 Claims, No Drawings

METHOD OF MAKING A NODULAR INORGANIC FIBROUS INSULATION

CROSS-REFERENCE TO RELATED APPLICATIONS

This application is a continuation of International Application No. PCT/US2004/043318, filed Dec. 22, 2004, which in turn claims the benefit of priority of U.S. Provisional Application No. 60/532,743, filed Dec. 23, 2003, U.S. Provisional Application No. 60/532,880, filed Dec. 23, 2003, U.S. Provisional Application No. 60/532,881, filed Dec. 23, 2003, and U.S. Provisional Application No. 60/532,882, filed Dec. 23, 2003, the entire contents of which are incorporated by reference herein.

BACKGROUND

Loose-fill fibrous insulation can be pumped or blown into an attic, wall or wall cavity of a building such as a residential home. Various materials can be added to the fibrous insulation to reduce settling and static discharge, as well as to reduce the amount of dust formed during installation. Conventional systems for forming an insulation product from a loose-fill fibrous insulation, and/or the use of a liquid binder dispersion or water to activate a powdered adhesive, are discussed in U.S. Pat. Nos. 4,710,480, 4,804,695, 5,641,368 and 5,952,418.

Conventional systems for forming an insulation product from loose-fill insulation typically present various disadvantages. For example, conventional systems often suffer from partial or complete blockage of an adhesive nozzle and/or a blowing hose through which the loose-fill insulation is blown. In addition, conventional systems typically employ a relatively high moisture content such as 50% of the dry weight of the preinstalled insulation, to enable proper adhesion between the insulation and the substrate. Such relatively high moisture content can cause mold-related problems such as mold growth on a paper facing of a wallboard. In addition, drying the installed insulation product having a relatively high moisture content can take a relatively long period of time such as two or more days. Such a prolonged drying period can slow down the installation process and contribute to the overall inefficiency thereof.

Conventional systems which use sprayed cellulose loose-fill insulation typically employ a high moisture content to ensure adhesion of the insulation in a cavity. For example, cellulose insulation typically contains water in an amount of 30% to 50% by weight of the insulation. This amount of moisture corresponds to about 2 to 3 pounds of water in the installed insulation per standard eight foot high wall cavity, i.e., a cavity defined by a construction of 8 foot high, nominal 2 by 4 inch framing members (actual 1.5 inch by 3.5 inch) on 16 inch centers. The term "on centers" refers to the distance between the centers of the framing members. This amount of moisture can cause the installation to have a drying time of 2 to 3 days or longer in a dry climatic region such as Denver, Colo. That is, a wallboard typically should be installed after 2 to 3 days or longer to reduce the potential for mold growth. In more humid regions such as Florida, the drying time is typically considerably longer. Longer drying times typically exist when the insulation is installed in a deeper cavity structure.

A dry powdered adhesive can be added to a cellulose insulation material prior to the addition of water to reduce the amount of water used to enable the cellulose to adhere to a wall cavity, as disclosed in U.S. Pat. No. 4,773,960. However, the moisture content of the insulation soon after installation typically remains relatively high, for example, as much as 15% water or more.

Furthermore, cellulose insulation typically has a relatively high moisture storage capacity, which can extend the drying period of the cellulose insulation. ASTM C739 which sets forth the specification for a cellulose loose-fill insulation material, allows a moisture sorption rate as high as 15%. ASTM C764 which sets forth the specification for an inorganic fiber loose-fill material, allows for a moisture sorption rate of only up to 5%.

In addition, it can be difficult to form an insulation product having an acceptable R-value from a loose-fill cellulose material due to the inherent density and thermal characteristics of the cellulose material.

In conventional systems which employ an insulation material having a preinstalled moisture content less than that used in cellulose insulation, the insulation typically does not sufficiently adhere to particular conventional linings of wall cavities causing collapse and lower productivity.

Other systems for installing loose-fill insulation into vertical wall cavities employ a retaining means such as netting or cardboard baffles to retain the loose-fill insulation during blowing. Installing the restraining means typically requires additional labor, for example, as much as an extra day of labor, and can substantially add to the cost of installing the insulation.

SUMMARY OF INVENTION

According to one aspect, a method of forming a nodular insulation material suitable for installation in a cavity is provided, comprising:

propelling fibrous nodules at a substrate, wherein the fibrous nodules are formed from inorganic fibers, wherein a majority of the nodules has a maximum dimension of about one-half inch, and contacting the nodules while the nodules are being propelled, with a solution comprising water and a water soluble binder to produce coated nodules, wherein the coated nodules form an insulation on the substrate.

DETAILED DESCRIPTION

A nodular insulation product can be formed by propelling fibrous nodules coated with a binder solution at a substrate on which the insulation is to be formed. The coated nodules can adhere to the surface(s) of the substrate and to other nodules to form the installed insulation product. The nodular fibrous insulation can be effective for providing thermal and/or acoustical insulation, and can be formed to comply with various existing and newly proposed building code requirements.

In an exemplary embodiment, the use of the fibrous nodules can enable the just-installed insulation to resist slumping and/or collapse. This in turn can lead to the formation of an insulation product having improved structural strength after the insulation is sufficiently dried. As used herein, the term "just-installed" refers to a time period within one hour of installation of the insulation product. For example, the insulation material can typically become sufficiently dry within one hour, more preferably within one-half hour, to enable determination of properties of a sample of the insulation product. For example, in one embodiment, the insulation can have a moisture content of about 5% to 20% after one-half hour. This period of time can depend on, for example, temperature, humidity, the permeability of surrounding materials, the amount of water initially present, and/or the airflow around the insulation. While it can sometimes take as long as one-half hour for the insulation material to be sufficiently dry for measurement, in some cases it can take a relatively short period of time such as 10 minutes.

The use of the fibrous nodules can result in an insulation product having good thermal insulation performance, good airflow resistance, a relatively low density, a relatively low moisture weight to facilitate drying, and/or a relatively fast installation time. For example, the resulting nodular fibrous insulation can have a low moisture sorption potential that is sufficient to decrease drying time and mold growth. The nodular fibrous insulation can also have relatively high thermal insulation performance at a relatively low density to enable a variety of R-values (thermal resistance values) in standard wall cavity depths.

The substrate at which the fibrous nodules can be propelled can include any material on which an insulation product is capable of being formed. For example, the substrate can include at least one surface and preferably a plurality of surfaces, at predetermined angular orientations. In an exemplary embodiment, the substrate can include at least one surface of a wall, floor or ceiling cavity in a residential or commercial building. In a preferred embodiment, the substrate can include a surface of a wall cavity at least defined by two framing members (such as beams, studs, etc.) and a rear backing surface. The framing members can be formed from any suitable material including, for example, wood and/or metal such as steel. The rear backing surface can be formed from any suitable material such as, for example, oriented strand board. The framing members can have any suitable dimensions, for example, nominal 2 by 4 inches or nominal 2 by 6 inches, and can be about 8 feet long or longer. The spacing interval between the framing members can be any suitable length to enable application of a spray-on insulation therebetween, such as about 16 inches on center or wider, preferably about 16 or about 24 inches on center. In an exemplary embodiment, the substrate can include a standard wall cavity. As used herein, the term "standard wall cavity" refers to a cavity formed by standard 2 by 4 inch studs, 8 feet high and 16 inches on center.

The nodular fibrous insulation can be formed at least from fibrous nodules bound together with a binder. The fibrous nodules can have any shape such as a generally random shape, and can be generally spherical in shape having one or more radii. The fibrous nodules can be relatively small in size, and preferably the nodules can be smaller in size than relatively large-sized clumps of insulation material used in conventional systems. As a result of using relatively small-sized nodules, the nodules can be greater in number than the relatively large-sized clumps used in conventional systems. For example, the maximum dimension of the fibrous nodules can be about three-quarters (¾) inch, preferably about one-half (½) inch, more preferably about one-quarter (¼) inch. As used herein, the term "maximum dimension" of a nodule refers to the longest of the width, length, thickness or diameter of such nodule.

The size of the nodules can depend on, for example, the thermal insulation performance desired, the desired R-value and density of the installed insulation, the size and shape of the volume to be insulated, and/or the relevant building code requirements. In an exemplary embodiment, the maximum dimension of a majority of the nodules, preferably at least about 70%, more preferably at least about 80%, and most preferably at least about 90%, can be about one-half inch. In a preferred embodiment, the maximum dimension of a majority of the nodules, preferably at least about 70%, more preferably at least about 80%, and most preferably at least about 90%, can be about one-quarter inch.

The nodular fibrous insulation can also contain, in addition to the fibrous nodules, particles that are larger than such fibrous nodules, hereinafter referred to as "clumps". Preferably, the nodular fibrous insulation can be substantially free of such clumps or has only a small amount of clumps. For example, such clumps can adversely affect the properties of the insulation by reducing thermal performance, producing voids in the insulation, detracting from the appearance of the insulation by making the surface thereof less uniform, and/or by being pulled out more easily during scrubbing of the insulation. Thus, in an exemplary embodiment, the insulation can be formed in a manner which results in the reduction or substantial removal of clumps therefrom.

The dimensions of the nodules can be measured by any suitable technique such as, for example, using a plurality of stacked screen sieves containing various screen mesh sizes to segregate the nodules; spreading out a sampling of the nodules on a horizontal flat surface and physically measuring each nodule within the sample with a tape measure; using various air flow resistance methods to correlate nodule size with air flow resistance readings; and/or using sonic energy measurements through samples to correlate sound energy with nodule size.

Conventional, relatively large-sized clumps typically do not provide the desired uniformity and aesthetically pleasing surface appearance to meet inspection standards and/or regulations, and to ensure consistent thermal performance. In addition, use of such clumps can lead to a relatively high occurrence of nozzle plugging, and can also hinder adequate wetting with a binder solution.

While not wishing to be bound by any particular theory, it is believed that the relatively small size of the fibrous nodules can provide various advantages in comparison with conventional, larger-sized clumps. For example, the fibrous nodules can increase adhesion between the installed insulation and various substrates such as wall cavity surfaces. Use of the fibrous nodules can also improve adhesion between the nodules themselves.

Use of the fibrous nodules can, for example, reduce or prevent the occurrence of clogging of a nozzle and/or hose through which the nodules are blown during application of the insulation. By reducing or avoiding such clogging, the amount of cleanup necessary can be reduced and/or the rate of application of the insulation can be increased. For example, the flow rate of the dry nodules ejected from a blowing machine can be from about 10 to about 50 lbs/min, more preferably about 20 to about 30 lbs/min. The amount of time it takes to fill a cavity with the insulation product can depend on at least the volume of the cavity. For example, the amount of time it takes to fill a standard wall cavity can be from about 5 to about 30 seconds, for example as long as about 20 to about 30 seconds, or as short as about 5 to about 15 seconds. As used herein, the term "standard wall cavity" refers to a cavity formed by standard 2 by 4 inch framing members, 8 feet high and 16 inches on center. The relatively small size of the nodules can improve wetting thereof by the binder solution. The insulation formed from the nodules can have good thermal and acoustical performance and an aesthetically pleasing surface appearance. The use of the nodules can also improve the consistency of the R-value of the insulation.

In an exemplary embodiment, the insulation formed from the fibrous nodules can have a reduced amount of gaps, voids and/or bridges formed from the nodules, as a result of the use of the relatively smaller sized nodules. Reducing the amount of gaps, voids and/or bridges present in the installed product can minimize heat transfer by convection. Use of the nodules can also result in increased uniformity in filling the framing faces of a cavity.

For example, the relatively small-sized nodules can enable filling around obstructions in building cavities such as electrical boxes, wiring and plumbing, thereby providing a substantially uniform and substantially void-free fill. In addition, the relatively small-sized nodules can allow the installer to maintain substantial surface flatness and uniformity in the insulation product after excess material is removed from the cavity framing faces. In addition, the fibrous nodules can form a more structurally uniform insulation product, for example, a substantially structurally uniform product.

Use of relatively small-sized and lightweight fibrous nodules can enable the insulation to have a relatively low density while still maintaining an acceptable thermal resistivity or R-value. As used herein, the term "R-value" refers to the thermal resistivity multiplied by the installed thickness of the insulation. For example, the insulation can have a thermal resistivity of from about 3.4 to about 4.0 hour-ft$^2$-° F./(Btu-inch) over an installed density of about 0.8 to 1.0 lbs/ft$^3$ (PCF). This corresponds to an R-value of from about 12 to about 14 hour-ft$^2$-° F./Btu in a nominal 2 by 4 inch cavity (3.5 inch actual cavity depth). Alternatively, the insulation can have a thermal resistivity of from about 4.0 to 4.6 hour-ft$^2$-° F./(Btu-inch) over an installed density of about 1.5 to 1.8 lbs/ft$^3$. This corresponds to an R-value of from about 14 to about 16 hour-ft$^2$-° F./Btu in a nominal 2 by 4 inch cavity (3.5 inch actual cavity depth). Maintaining a relatively low density can enable the insulation to be cost-competitive with low cost cellulose material and other similar materials. The low density of the installation can also facilitate reduction of drying time.

The fibrous nodules can contain additives such as, for example, an anti-static agent, a de-dusting oil, a hydrophobic agent such as a silicone, a biocide, a fungicide and/or a fire retardant. In conventional systems, the use of a hydrophobic agent such as silicone has been found to necessitate the use of an additional amount of adhesive. The use of the fibrous nodules as described herein can enable a hydrophobic agent to be used, for example, without necessitating the use of an excessive amount of adhesive. The fungicide can include, for example, benzimidazole 2-(4-thiazolyl), available under the trade name Irgaguard F3000 from Ciba Specialty Chemicals, Inc., located in Tarrytown, N.Y.

The fibrous nodules can include inorganic fibers formed from a material that is effective to provide, for example, thermal and/or acoustical insulation. For example, the inorganic fibers can be formed from glass fibers, slag wool, mineral wool, rock wool, ceramic fibers, carbon fibers, composite fibers and mixtures thereof. Preferably, the inorganic fibers can have a relatively small diameter, and more preferably can at least be formed from glass fibers having a relatively small diameter.

Inorganic fibers having a relatively small diameter can provide an improved degree of infrared radiation absorption and scattering capability because the inorganic fibers can have a higher surface area per mass ratio in comparison with fibrous materials formed from larger fibers. In addition, inorganic fibers having a relatively small diameter can be effective to create small pockets of still air which can be effective to reduce solid material conduction through the fibers.

The inorganic fibers can have any dimensions suitable for providing thermal and/or acoustical insulation. For example, the inorganic fibers can have an average diameter of about 3 microns or less, preferably about 2.5 microns or less, more preferably about 2 microns or less, more preferably about 1.5 microns or less, and most preferably about 1 micron or less. In an exemplary embodiment, the inorganic fibers can have relatively low moisture absorption and adsorption potential, for example, preferably less than about 5% moisture gain by weight. Such low moisture sorption potential can enable faster drying and can limit moisture storage capacity which can in turn reduce mold growth.

The inorganic fibers can include additives to improve thermal insulation performance. Some studies have shown that if convection is minimized, infrared radiation can account for about 30 to 40% of the heat flow through a fibrous insulation product. In an exemplary embodiment, the inorganic fibers can include an infrared radiation blocking agent of a reflecting, scattering and/or absorbing type. In an exemplary embodiment, the infrared radiation blocking agent can include $B_2O_3$, for example, in an amount of at least about 8%.

Such additive(s) for improving thermal insulation performance can be added to the insulation in any suitable manner including, for example, including the additive(s) in the glass chemistry, applying the additive(s) to the inorganic fibers as a coating such as a surface coating, mixing the additive(s) with the inorganic fibers, and/or introducing the additive(s) to the binder solution.

The fibrous nodules can be formed by processing a fibrous source material containing the inorganic fibers. In an exemplary embodiment, the fibrous source material can be provided in the form of a substance or a plurality of particles which is/are relatively large in size, and such substance or particles can be reduced in size to form the fibrous nodules.

For example, the fibrous source material can be provided in any form suitable for being reduced to relatively small-sized nodules. The fibrous source material can include, for example, a fibrous blanket such as a fiberglass blanket in which the glass fibers are bonded together with a cured resin, a blanket of virgin fiberglass, or combinations thereof. Additionally or alternatively, the fibrous source material can include virgin blowing wool which is substantially free of a binder. The fibrous source material can contain at least one additive such as, for example, an infrared blocking agent, an anti-static agent, a silicone, a lubricating oil, an anti-fungal agent, a biocide, a de-dusting agent such as a hydrocarbon, a pigment or colorant and/or filler particles. Prior to applying a binder solution to the fibrous nodules, the nodules can have an organic content of from about 0.1 to about 10 wt. percent, for example, from about 2.0 to about 10 wt. percent, as measured by the loss on ignition test set forth in ASTM C764.

The fibrous nodules can be formed using any suitable process and equipment. In an exemplary embodiment, a system for forming the nodules can include an apparatus for reducing the size of a fibrous source material to form the nodules, and an exit screen having a plurality of openings of a pre-selected size which is effective to substantially control the size of the nodules exiting from the system.

For example, a hammer mill can be used which can tear and shear fibrous particles or a fibrous sheet, and can roll such particles into generally irregular spherical or rounded nodules. The hammer mill can keep most particles in the mill until they reach a pre-selected size. An additive can be added to the material during processing in the hammer mill such as, for example, an infrared barrier agent, an anti-static agent, an anti-fungal agent, a biocide, a de-dusting agent, a pigment and/or colorant. Alternatively, a slicer-dicer apparatus can be used which can cut or shear a sheet of fiberglass insulation into smaller particles, for example, into cube-like particles.

The size of the plurality of openings of the exit screen can be pre-selected to yield a desired nodule size. The size of the plurality of openings can depend on, for example, the type of fibrous source material that is used, and the manner in which the nodules are processed. In an exemplary embodiment, for fiberglass material, the plurality of openings can be substantially square-shaped and range in size from about 1 to about 3 inches to produce particles that range in size from about ⅛ inch to about ¾ inch. In a preferred embodiment, an exit screen can be used which includes a pattern of 2 inch by 2 inch substantially square openings or 2 inch diameter substantially circular openings. Such an exit screen can produce, for example, particles containing nodules having a maximum dimension of ¼ inch.

A binder solution can be applied to the nodules which can enable the nodules to adhere to a substrate at which the nodules are propelled. The binder solution can also enable the nodules to adhere together to form an insulation product on and/or above the substrate. The binder solution can include, for example, a water-soluble binder and water. The binder solution can be provided as a premixed solution, or the binder solution can be produced by adding water and a binder material to a tank and optionally stirring the resulting mixture. The binder material can be provided in the form of a concentrated solution or a powder. In the case a powdered binder material is used, the mixture can be stirred for a longer period of time to ensure proper mixture of the materials. The mixture can optionally be heated to at least room temperature.

The binder used to form the binder solution can include any material that enables the nodules to substantially adhere to the substrate surface and to other nodules, and can include, for example, resin solids. Preferably, the binder can provide sufficient adhesion to reduce or prevent settling, collapsing or slumping of the installed insulation. The binder can include a liquid-soluble binder, preferably a water-soluble binder. For example, the binder can include a water-soluble polymer, resin or oligomer, such as a water-soluble partially hydrolyzed polyester oligomer, polyvinyl acetate, polyvinyl pyrilidone, polyvinyl alcohol or mixtures thereof. In an exemplary embodiment, the binder can include a partially hydrolyzed polyester oligomer such as S-14063 and/or SA-3915 available from Sovereign Specialty Chemicals located in Greenville, S.C. The S-14063 resin contains 23% to 36% solids, and can be mixed with water, for example, at a water to binder ratio of about 0.5:1 to about 2:1, preferably about 1:1. The SA-3915 adhesive contains 10% to 15% solids and can be used without further addition of water.

The binder solution can optionally include at least one additive such as, for example, an anti-freezing agent, a viscosity modifying agent, a biocide, a pigment.

The binder can be present in the binder solution in an amount that enables the nodules to substantially adhere to the substrate surface and to other nodules. Preferably, the binder can be present in an amount which provides sufficient adhesion to reduce or prevent settling, collapsing or slumping of the installed insulation. For example, the binder can be present in an amount from about 10% to about 50%, preferably from about 10% to about 20%, based on the volume of the binder solution.

After installation and drying of the insulation, the binder can be present in the dried insulation product in an amount of less than about 6 wt. percent, preferably from about 2 wt. percent to about 6 wt. percent, more preferably from about 2 wt. percent to about 4 wt. percent, most preferably about 3 wt. percent, on an oven dry basis, for example, of an installed product having an installed density ranging from about 0.8 to about 1.0 PCF. As used herein, the terms "oven dry basis" and "oven dry" refer to the material in question being measured while being substantially free of moisture. In addition, as used herein, the terms "ambient dry basis" and "ambient dry" refer to the material in question being measured after equilibrating to ambient conditions, in which case the material can contain an amount of moisture during measurement.

The nodules can be contacted with the binder solution to produce coated nodules. The term "coated nodules" encompasses nodules which are partially or substantially entirely coated with the binder solution. The binder solution can be present at an outer region of the coated nodules, for example, at the surface of the coated nodules. The nodules can be contacted with the binder solution while the nodules are being propelled. For example, the nodules can be contacted with the binder solution while the nodules are ejected from a nozzle or at a time thereafter but prior to the nodules contacting the substrate.

The coated nodules can be used to form an insulation product in a wall cavity. To ensure complete filling of the cavity, the coated nodules can be applied in an amount such that the insulation overflows from the cavity. For example, the installed insulation can extend past the face of the frame which defines the cavity. Thereafter, excess insulation material can be removed, rolled and/or compressed, for example, to substantially level the insulation with the face of the frame defining the wall cavity. Leveling the insulation can enable a wall board or other facing board to be installed substantially flush with the face of the frame. In an exemplary embodiment, excess insulation can be removed without rolling or compressing the insulation.

The insulation formed from the nodules and binder solution can be installed using any system suitable for applying a fibrous insulation onto a substrate. For example, the insulation can be applied using a commercially available blowing system such as a system specifically designed for cellulose blowing.

In an exemplary embodiment, the nodules can be provided to a hopper of a blowing machine. The blowing machine can mix the nodules with air and eject such mixture as a rapidly moving air suspension from an outlet. A hose can be connected to the outlet and convey the nodules to the substrate on which the insulation is to be formed. Any suitable hose can be used, for example, a hose as long as 300 feet having a diameter from about 2.5 inches to about 4 inches.

The hose can have a nozzle attached to an end thereof through which the nodules are ejected. A handle can be provided to assist an operator to hold and aim the nozzle during application of the nodules. The nozzle can have at least one jet spray tip for contacting the binder solution with the nodules near the exit end of the nozzle, preferably at or past the exit end. In an exemplary embodiment, two or three jet spray tips can be used opposite each other across a moving stream of suspended nodules. For example, an exemplary jet spray tip which can be used is available under the trade name Unijet (25 degree or 65 degree spray), available from Spraying Systems Co. located in Wheaton, Ill. Other exemplary nozzles which can be used are described in, for example, U.S. Pat. Nos. 5,641,368 and 5,921,055. A pump such as an adjustable rate pump can be connected to a tank containing the binder solution to provide the binder solution at a pre-selected flow rate and pressure to the jet spray tips of the nozzle through one or more flexible hoses. The flow rate and pressure of the binder solution is preferably pre-selected to enable adequate coating of the nodules with the binder solution.

An excessive amount of insulation material can be formed on the substrate, and such excessive insulation can be removed using any suitable means. For example, an amount of insulation material can be removed to substantially align the insulation product with the framing members that define the cavity in which the insulation product is formed. The use of the relatively smaller sized nodules can enable removal of excessive material while maintaining a substantially smooth, even surface of the insulation product.

For example, a powered scrubber including a rotating brush-like device can be used to reduce or remove the excess insulation. The powered scrubber can span two adjacent wall studs. Water or other liquid is preferably not used with the powered scrubber. In conventional insulation systems, the rotating action of the powered scrubber can lead to damage of the insulation such as the tearing of large chunks of the insulation from the cavity. The use of the powered scrubber with the insulation formed by the present methods can reduce or avoid the occurrence of the tearing of large chunks of the insulation from the cavity. This can be a result of, for example, a higher degree of tackiness between the nodules, the smaller size of the nodules, and/or the reduction of voids in the insulation product.

The just-installed insulation product can have a relatively low moisture content, which can in turn contribute to reducing drying time and/or minimizing the potential for mold growth. For example, the coated nodules can have a moisture content of less than about 25 wt. percent, preferably less than about 20 wt. percent, more preferably less than about 15 wt. percent, more preferably less than about 10 wt. percent, based on the dry weight of the nodules. For example, the water present in the just-installed insulation can be from about 10 wt. percent to about 30 wt. percent, preferably from about 10 wt. percent to about 20 wt. percent, based on the dry weight of the nodules.

The moisture content in the just-installed insulation product can be less than about 2.0 lbs of water per standard wall cavity. For example, the moisture content can be less than about 0.75 lbs, more preferably less than about 0.50 lbs, and most preferably less than about 0.25 lbs of water in a standard wall cavity, for example, for an installed insulation product having an R-value of 13 and an oven dry density from about 0.8 to about 1.0 PCF. Alternatively, the moisture content can be less than about 2.0 lbs, more preferably less than about 1.5 lbs, and most preferably less than about 0.50 lbs of water in a standard wall cavity, for example, for an installed insulation product having an R-value of 15 and an oven dry density from about 1.5 to about 1.8 PCF.

While not wishing to be bound by any particular theory, Applicants believe that the weight of water in a standard wall cavity or other unit volume can be an accurate indicator of the amount of time needed to sufficiently dry the insulation. For example, the amount of water in a standard wall cavity or other unit volume may be a more accurate indication of drying time than, for example, the moisture content percentage in the insulation, since drying time is typically dependent on the total amount of water present. In this regard, the moisture content percentage is with respect to the weight of the material itself, and does not necessarily indicate the total amount of water present.

The resultant coated nodules of inorganic fiber insulation can contain binder solids in an amount of less than about 6 wt. percent, preferably less than about 4 wt. percent, and more preferably less than about 3 wt. percent, based on the dry weight of the nodules, for installed densities ranging from about 0.8 to about 1.0 PCF.

The insulation product can have a density preferably of about 3 PCF or less, more preferably about 2 PCF or less and most preferably about 1 PCF or less. The density can depend to some extent on the R-value desired. The R-value of the insulation product can be, for example, from about 12 to about 16. For example, in a standard wall cavity, the dried installed insulation product can have a density from about 0.8 to about 1 PCF and an R-value of about 13, or a density from about 1.5 to about 1.8 PCF and an R-value of about 15. The relatively low density and low moisture content of the insulation product can result in reducing the cost and improving drying time in comparison with conventional systems.

In an exemplary embodiment, the distance the nodules are propelled can be selected to achieve a predetermined density of the nodular insulation material. For example, the nozzle can be held at a particular distance from the substrate in order to achieve a predetermined density of the nodular insulation material.

EXAMPLES

Example 1

Nodules formed from glass fibers were provided which were mostly roughly spherical in shape and had an average diameter or length of about ¼ inch. A majority of the nodules had a maximum dimension of ½ inch or less. The glass fibers had an average diameter of 2.0 microns and contained $B_2O_3$ in an amount of 8.7 wt. %. The glass fibers had on their surface a silicone agent in an amount of 0.05 wt. % and a de-dusting oil in an amount of 0.06 wt. %, based on the weight of the glass fibers.

A blowing machine available from Unisul under the trade name Volumatic® III, was used to blow the nodules at a wall cavity. The blowing machine was equipped with 150 feet of 4-inch diameter hose and provided a nodule mass flow rate of approximately 18 lbs/min. The blowing machine was operated with the transmission in third gear with 100% of the available blower air delivered to the rotary airlock assembly and with the slide gate (feed gate) set at 12 inches. The blower and secondary gearbox speeds (rpm settings) on the blowing machine were set to the manufacturer's recommended settings of 1425 rpm and 1050 rpm, respectively.

The nodules flowed through the blowing hose and out from a nozzle. A spray assembly was used to apply a binder solution to the nodules as they exited the hose. The spray assembly included a 4 inch diameter tube connected to a binder solution source. A pump available from Spray Tech, model 0295003, was used to generate flow of the binder solution. The nozzle was surrounded by an annular manifold containing two spray tips available from Spray System Co. model TPU-65-015. The spray tips were screwed into threaded ports located 180 degrees apart on the manifold. The ports were set at a 30 degree angle to the centerline of the direction of the nodule flow. The arrangement of the spray tips enabled the binder solution to be contacted with the nodules without substantially disrupting the flow of the nodules.

The binder solution was formed from a 1:1 volumetric mixture of water and an acrylic resin solution available from Sovereign Chemical under the trade name S-14063. The flow rate of the binder solution was 0.5 gallons/minute.

The insulation was applied to a wall cavity by pointing the nozzle from the bottom to the top of the cavity, and with a side to side motion. In this example, the nozzle was held approximately 6 feet away from the open cavity faces during the installation process. The coated nodules formed a substantially consistent fill in the cavity with about a 2 to 3 inch thickness of excess material extending beyond the face of the wooden beams.

Shortly after installation, excess insulation material was removed with the use of a commercial rotary wall scrubber available from Krendl Machine Co., located in Delphos, Ohio, under Model No. 349B. The removed excess material was vacuumed using a 50 foot length of 4 inch diameter hose connected to a centrifugal vacuum fan available from Wm. W. Meyer & Sons, Inc., under the trade name Versa-Vac (11).

Four wall cavities of varying sizes were insulated, hereinafter referred to as Samples 1 to 4, respectively. Sample 1 was defined by 8 foot high vertical, 2 by 4 inch wooden beams spaced on a 16 inch center. Sample 2 was defined by 8 foot high vertical, 2 by 4 inch wooden beams spaced on a 24 inch center. Sample 3 was defined by 8 foot high vertical, 2 by 6 inch wooden beams spaced on a 16 inch center. Sample 4 was defined by 8 foot high vertical, 2 by 6 inch wooden beams spaced on a 24 inch center. Standard SPF wood framing was used to form the side and top walls of each cavity, and oriented strand board (OSB) sheathing was used as the back wall of each cavity. The results are shown in the following Table 1.

In the Examples, the ratio of the binder solution to dry nodules represents the ratio of the flow rate of the binder solution to the flow rate of the dry nodules, by weight. The just-installed moisture content was measured using a load cell connected to a chain hoist. A large oven was used to dry the samples after the initial weights were taken. The moisture content of the just-installed insulation was measured on an oven dry mass basis.

TABLE 1

Installation Using a Nozzle Positioned Six Feet from the Cavity

| | Sample 1 (2 by 4 in, 16 in OC) | Sample 2 (2 by 4 in, 24 in OC) | Sample 3 (2 by 6 in, 16 in OC) | Sample 4 (2 by 6 in, 24 in OC) |
|---|---|---|---|---|
| Ratio of Binder Solution to Dry Nodules | 0.24-0.26 | 0.24-0.26 | 0.24-0.26 | 0.24-0.26 |
| Just-installed Moisture, wt. % | 20-30 | 20-30 | 20-30 | 20-30 |
| Just-installed Amount of Water per Cavity, lbs/cavity | 0.5-0.7 | 0.8-1.1 | 0.8-1.2 | 1.2-1.8 |
| Installation Time, sec/cavity | 10 | 15 | 15 | 24 |
| Dry Insulation Density, PCF | 0.8-0.9 | 0.8-0.9 | 0.8-0.9 | 0.8-0.9 |
| R-value | 13 | 13 | 20 | 20 |

In Example 1, loss-on-ignition (LOI) testing indicated that approximately 2 to 3% adhesive solids existed in the installed material. In each of Samples 1 to 4, the installed material remained in the cavity and did not undergo settling.

Example 2

Insulation was formed in the same manner as described in Example 1, except that the nozzle was positioned two feet from the cavity instead of six feet from the cavity during application of the coated nodules to the cavity. The results are set forth in the following Table 2.

TABLE 2

Installation Using a Nozzle Position Two Feet from the Cavity

| | Sample 5 (2 by 4 in, 16 in OC) | Sample 6 (2 by 4 in, 24 in OC) | Sample 7 (2 by 6 in, 16 in OC) | Sample 8 (2 by 6 in, 24 in OC) |
|---|---|---|---|---|
| Ratio of Binder Solution to Dry Nodules | 0.24-0.26 | 0.24-0.26 | 0.24-0.26 | 0.24-0.26 |
| Just-Installed Moisture, wt. % | 20-30 | 20-30 | 20-30 | 20-30 |

TABLE 2-continued

Installation Using a Nozzle Position Two Feet from the Cavity

| | Sample 5 (2 by 4 in, 16 in OC) | Sample 6 (2 by 4 in, 24 in OC) | Sample 7 (2 by 6 in, 16 in OC) | Sample 8 (2 by 6 in, 24 in OC) |
|---|---|---|---|---|
| Just-installed Amount of Water per Cavity, lbs/cavity | 1.0-1.5 | 1.5-2.3 | 1.5-2.3 | 2.4-3.6 |
| Installation Time, sec/cavity | 21 | 32 | 33 | 51 |
| Dry Insulation Density, PCF | 1.7-1.8 | 1.7.-1.8 | 1.7-1.8 | 1.7-1.8 |
| R-value | 15 | 15 | 23 | 23 |

In comparing the results shown in Tables 1 and 2, applying the coated nodules with a 6-foot distance between the nozzle and the cavity resulted in an insulation density of from 0.8 to 0.9 PCF, whereas applying the coated nodules with a 2-foot distance between the nozzle and the cavity resulted in an insulation density of from 1.7 to 1.8 PCF. Additional tests were conducted (not shown in Table 2) in the same manner as described in Example 1, except that the coated nodules were applied with a 4-foot distance between the nozzle and the cavity. The density of the insulation formed from such additional tests was from 1.3 to 1.5 PCF. The above experimental results show that the density of the installed insulation can be controlled by varying the distance between the nozzle and the substrate on which the insulation is formed.

Example 3

Insulation was formed in the same manner as described in Example 1, except that the slide gate on the blowing machine was set to 7 inches, i.e., about 40% open. At such setting, the mass flow rate of the dry nodules was about 10 lbs/min instead of the 18 lbs/min flow rate employed in Example 1. The results of such tests are set forth in the following Table 3.

TABLE 3

Installation Using a Reduced Nodule Flow Rate

| | Sample 9 (2 by 4 in, 16 in OC) | Sample 10 (2 by 4 in, 24 in OC) | Sample 11 (2 by 6 in, 16 in OC) | Sample 12 (2 by 6 in, 24 in OC) |
|---|---|---|---|---|
| Ratio of Binder Solution to Dry Nodules | 0.43-0.53 | 0.43-0.53 | 0.43-0.53 | 0.43-0.53 |
| Just-Installed Moisture, wt. % | 45 | 45 | 45 | 45 |
| Just-installed Amount of Water per Cavity, lbs/cavity | 1.2 | 1.9 | 1.9 | 3 |
| Installation Time, sec/cavity | 15 | 20 | 20 | 29 |
| Dry Insulation Density, PCF | 0.8-0.9 | 0.8-0.9 | 0.8-0.9 | 0.8-0.9 |
| R-value | 13 | 13 | 20 | 20 |

As can be seen from Table 3, due to the reduced flow rate of the dry nodules, the ratio of the binder solution to the dry nodules was higher in comparison with the ratios obtained in Example 1. In addition, the just-installed product had an additional amount of moisture and as a result, an additional amount of time was required to install the insulation in each cavity. The above results show that the use of a reduced flow rate of dry nodules can result in an increase in installation cost due to an increased amount of binder solution usage and an increase in installation time.

Example 4

Insulation was formed in the same manner as discussed above in Example 1, except that instead of a 1:1 volumetric mixture of water and the S-14063 adhesive, a water to adhesive ratio of 2:1 was used to form the binder solution. The results of such tests are set forth in the following Table 4.

TABLE 4

| Installation Using a Diluted Binder Solution | | | | |
|---|---|---|---|---|
| | Sample 13 (2 by 4 in, 16 in OC) | Sample 14 (2 by 4 in, 24 in OC) | Sample 15 (2 by 6 in, 16 in OC) | Sample 16 (2 by 6 in, 24 in OC) |
| Ratio of Binder Solution to Dry Nodules | 0.23-0.25 | 0.23-0.25 | 0.23-0.25 | 0.23-0.25 |
| Just-installed Moisture, wt. % | 23 | 23 | 23 | 23 |
| Just-installed Amount of Water per Cavity, lbs/cavity | 0.6 | 0.9 | 0.9 | 1.4 |
| Installation Time, sec/cavity | 10 | 15 | 15 | 24 |
| Dry Insulation Density, PCF | 0.8-0.9 | 0.8-0.9 | 0.8-0.9 | 0.8-0.9 |
| R-value | 13 | 13 | 20 | 20 |

In this example, the ratio of water to binder solids was increased, but no significant difference in drying time resulted. The reduction in the amount of adhesive led to a reduction in cost in comparison with Example 1. Using less adhesive may result in less adhesion between the nodules and the cavity.

Example 5

Insulation was formed in the same manner as described in Example 1, except that the slide gate on the blowing machine was opened to 15 inches (86% open), and as a result the mass flow rate of dry nodules was increased to 22 lbs/min. In addition, the flow rate of the binder solution was increased from 0.5 gallons/minute to 0.7 gallons/minute. The results are shown in the following Table 5.

TABLE 5

| Installation Using an Increased Dry Nodule Flow Rate and Increased Binder Solution Flow Rate | | | | |
|---|---|---|---|---|
| | Sample 17 (2 by 4 in, 16 in OC) | Sample 18 (2 by 4 in, 24 in OC) | Sample 19 (2 by 6 in, 16 in OC) | Sample 20 (2 by 6 in, 24 in OC) |
| Ratio of Binder Solution to Dry Nodules | 0.27-0.30 | 0.27-0.30 | 0.27-0.30 | 0.27-0.30 |
| Just-installed Moisture, wt. % | 25 | 25 | 25 | 25 |
| Just-installed Amount of Water per Cavity, lbs/cavity | 0.7 | 1.1 | 1.1 | 1.7 |
| Installation Time, sec/cavity | 9 | 14 | 14 | 22 |
| Dry Insulation Density, PCF | 0.8-0.9 | 0.8-0.9 | 0.8-0.9 | 0.8-0.9 |
| R-value | 13 | 13 | 20 | 20 |

In this Example, the installation time was improved in comparison with the samples set forth in Example 1.

Several examples and ranges of parameters of preferred embodiments of the present invention have been described above, but it will be apparent to those of ordinary skill in the insulation field that many other embodiments by manipulation of the parameters can be employed. For example, although only a few different resin binders are specifically disclosed, there are many soluble binders that can function in the above disclosed invention to produce the useful result of having sufficient tack value. While most of the above discussion involves using the present invention in generally vertical wall cavities, this insulation product can be used to insulate attics or any suitable area.

The invention claimed is:

1. A method of forming a nodular insulation material suitable for installation in a cavity, comprising:

propelling fibrous nodules at a substrate, wherein the fibrous nodules are formed from inorganic fibers, wherein a majority of the nodules has a maximum dimension of about one-half inch, and contacting the nodules while the nodules are being propelled, with a solution comprising water and a water soluble binder to produce coated nodules, wherein the coated nodules form a just installed insulation on the substrate, the just installed insulation having a moisture content of less than about 2 pounds per standard wall cavity and and comprising an additive effective for increasing the thermal insulation performance of the insulation, the additive including an infrared radiation blocking agent.

2. The method of claim 1, wherein when the just-installed moisture content of the insulation is less than about 1.5 pounds.

3. The method of claim 1, wherein the additive is present in an amount of at least about 8 wt. percent.

4. The method of claim 2, wherein the nodules are propelled at a cavity to form the insulation in the cavity and wherein the additive is present in an amount of at least about 8 wt. percent.

5. The method of claim 4, wherein some of the nodules contact and adhere to at least one wall of the cavity, and some of the nodules contact and adhere to other nodules, to form the insulation.

6. The method of claim 1, wherein the insulation has an R value from about 12 to about 16 after drying.

7. The method of claim 1, wherein the insulation has a density of about 3 PCF or less after drying.

8. The method of claim 1, wherein the inorganic fibers comprise glass fibers.

9. The method of claim 1, wherein the nodules comprise glass fibers bonded together with a cured resin at one or more locations where two or more of the glass fibers cross one another.

10. The method of claim 1, wherein at least about 70 percent of the coated nodules have a maximum dimension of one-quarter inch.

11. The method of claim 1, wherein at least about 80 percent of the coated nodules have a maximum dimension of one-half inch.

12. The method of claim 11, wherein at least about 90 percent of the coated nodules have a maximum dimension of one-half inch.

13. The method of claim 1, wherein the water soluble binder comprises a partially hydrolyzed polyester oligomer.

14. The method of claim 1, wherein the binder is present in the insulation in an amount of less than about 6 wt. percent, on a dry solids basis.

15. The method of claim 1, wherein the binder is present in the insulation in an amount of less than about 4 wt. percent, on a dry solids basis.

16. The method of claim 10, wherein the inorganic fibers have an average fiber diameter of 3 microns or less.

17. The method of claim 1, wherein the substrate at which the fibrous nodules are propelled comprises a surface of a wall, floor or ceiling cavity.

18. The method of claim 17, wherein the wall, floor or ceiling cavity is an open cavity.

19. The method of claim 1, wherein the distance the nodules are propelled is selected to achieve a predetermined density of the nodular insulation material.

20. The method of claim 1, wherein the nodules are propelled from a nozzle, and the distance between the nozzle and the substrate is selected to achieve a predetermined density of the nodular insulation material.

21. The method of claim 1, wherein the flow rate of the fibrous nodules propelled at the substrate is from about 10 to about 50 lbs/mm.

22. The method of claim 16, wherein the flow rate of the fibrous nodules propelled at the substrate is from about 20 to about 30 lbs/min.

23. The method of claim 1, wherein the fibrous nodules comprise the additive effective for increasing the thermal insulation performance.

24. The method of claim 2, wherein the insulation has a density of about 3 PCF or less after drying.

25. The method of claim 23, wherein the additive effective for increasing thermal insulation comprises an infrared radiation blocking agent in an amount of at feast about 8%.

26. The method of claim 25, wherein the infrared radiation blocking agent comprises $B_2O_3$.

27. The method of claim 1, wherein the fibrous nodules comprise a fire retardant.

28. The method of claim 1, wherein the insulation formed on the substrate comprises a fire retardant.

* * * * *